US005863072A

United States Patent [19]

Sommer

[11] Patent Number: 5,863,072

[45] Date of Patent: Jan. 26, 1999

[54] DATA TAG FOR WRITING IMPLEMENTS

[75] Inventor: Gerhard F. Sommer, Hamburg, Germany

[73] Assignee: Pelikan GmbH, Hanover, Germany

[21] Appl. No.: 741,929

[22] Filed: Oct. 31, 1996

[30] Foreign Application Priority Data

Nov. 12, 1995 [DE] Germany ..... 295 18 396.9

[51] Int. Cl.[6] ..... B42D 15/00; G09F 3/10

[52] U.S. Cl. ..... 283/62; 283/61; 283/42; 40/299; 40/321; 40/334; 40/310; 40/307; 40/305

[58] Field of Search ..... 283/61, 62, 42; 40/299, 321, 334, 310, 307, 305

[56] References Cited

U.S. PATENT DOCUMENTS

| | | | |
|---|---|---|---|
| 1,049,275 | 12/1912 | Scott . | |
| 1,262,972 | 4/1918 | Olson . | |
| 1,297,017 | 3/1919 | Scott . | |
| 1,401,454 | 12/1921 | Andersen . | |
| 1,712,380 | 5/1929 | De Courten et al. . | |
| 2,005,110 | 6/1935 | Ritzert . | |
| 2,475,934 | 7/1949 | Wuestman . | |
| 2,620,143 | 12/1952 | Armelin . | |
| 2,808,670 | 10/1957 | Katz . | |
| 2,971,283 | 2/1961 | Parker . | |
| 3,156,960 | 11/1964 | Klitzner . | |
| 3,250,033 | 5/1966 | Siegel . | |
| 4,706,995 | 11/1987 | Dopp | 281/42 |

FOREIGN PATENT DOCUMENTS

| | | |
|---|---|---|
| 2 665 009 | 1/1992 | France . |
| 224420 | 2/1943 | Switzerland . |
| 93/17412 | 9/1993 | WIPO . |

*Primary Examiner*—Frances Han
*Attorney, Agent, or Firm*—Nikaido Marmelstein Murray & Oram, LLP

[57] ABSTRACT

A data tag(1) for a writing implement (8) fitted with a clip (7). The clip has a longitudinal recess in its underside facing the writing implement (8). The tag is a strip of material (1) with a tab (2). The tab is insertable into the clearance between the writing implement (8) and the clip (7). The tab (2) is fitted at its top side facing the clip (7) with a folded and raised lip (5) which, in the insertion mode of the tab (2), snaps into the recess (11) and rests against the clip (7) in a direction opposite that of insertion. A resting edge (3, 4) is present on each side of the tab (2) and can be made to abut both the affixing end (10) of the clip (7) and the clip bead resting against the writing implement (8) for the purpose of limiting depth of insertion of the tab (2).

1 Claim, 1 Drawing Sheet

FIG.1
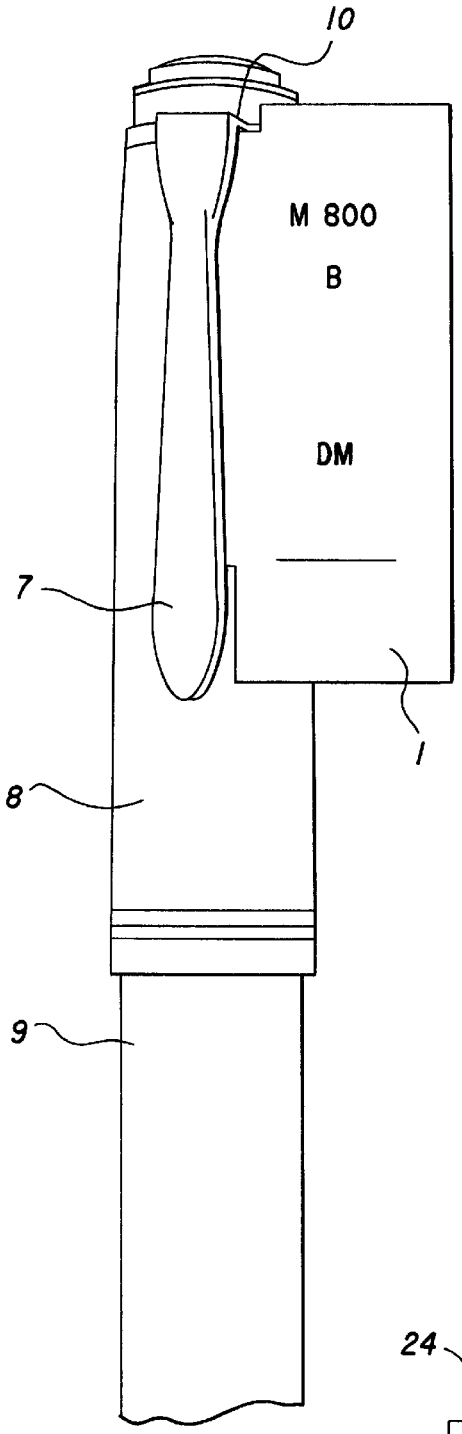
FIG.2
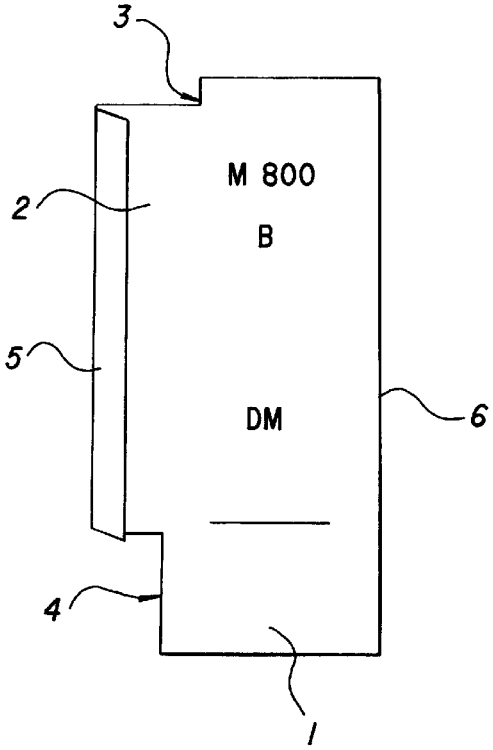
FIG.3
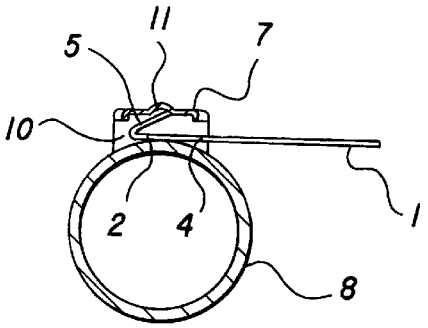
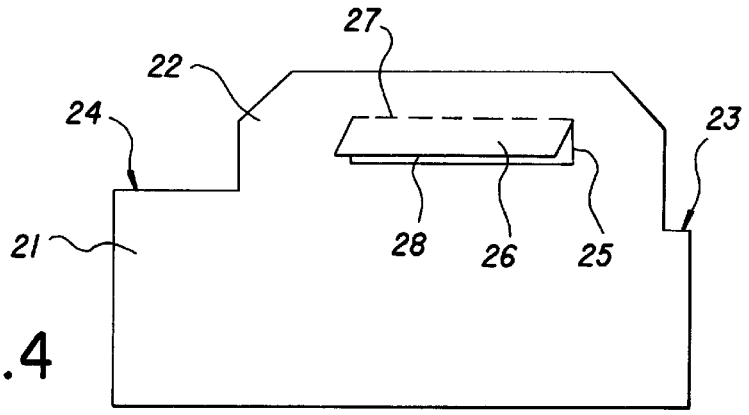
FIG.4

DATA TAG FOR WRITING IMPLEMENTS

The invention concerns a data tag for clip-fitted writing implements wherein the clip has a recess on its underside facing the writing implement and running in the longitudinal clip direction.

There is need in commerce for writing-implement data tags showing the features of the implement, the price and a machine-readable bar code. Affixing such a data tag to the particular writing implement should be as simple as possible. Additionally, high-priced writing implements must not be damaged by such data tags. Moreover the data tag linked to the writing implement should be affixable in a predetermined position of the implement allowing optimum optical response and be advantageous in data-tag readout.

The object of the invention is to create a data tag for clip-fitted writing implements that meets the above requirements.

The invention solves this problem using a strip of material with a tab insertable into the clearance between the writing implement and the clip, the tab comprising at its upper side facing the clip a rising lip formed by the bent-over edge of this tab or by an incision in this tab, the lip being receivable by its raised end in the recess of the clip when the tab is inserted and resting on the clip in the direction opposite the direction of insertion. The strip of material additionally has resting edges on both sides of the tab, the edges being able to move against the clip affixation end and the clip-yoke resting against the writing implement in order to limit the depth of insertion of the tab.

The data tag of the invention is connectable by a simple plug-in procedure to the writing implement. In the process the tab is displaced into the recess underneath the clip, the raised lip thereby being forced down and arriving in a position underneath the clip wherein it rests against the clip opposite the direction of insertion. The tab being biased to rise, it will snap into the clip recess when reaching this recess and as a result acts like a pawl to preclude the tab from being pulled out of the clearance again. In this position the data tag is fixed in its position by the lip due to latter's resting edges and the bead of the clip and the lateral boundaries formed by the fastening yoke of the clip, being substantially tangential to the writing implement and thus being well legible from both sides. When in its affixed position, the data tag rests merely loosely against the writing implement and the clip, requiring no adhesive that might soil or damage the writing implement. Preferably paperboard or a comparably soft material shall be used for the manufacture of the strip of material, whereby the surface of the writing implement further shall be precluded from damage. If the bent-over edge of the tab forms the raised lip, the flexural resistance of the data tag shall be increased thereby.

In the invention the raised lip also may be formed by an essentially U-shaped incision in the tab and be raised at or folded about a folding line connecting the open ends of the U-shaped incision. This design of raised lip is also suitable for writing implements of which the clip lacks a recess on its underside facing the implement because the raised lip, provided it be sufficiently long, will be able to span the clip on the side away from the resting edges and thus exert adequate retaining force.

The invention is elucidated below in relation to an illustrative embodiment shown in the drawings.

FIG. 1 is an elevation of the cap-side end of a fountain pen having a data tag of the invention affixed to the clip of the fountain-pen cap;

FIG. 2 is an elevation of the tag of FIG. 1;

FIG. 3 is a cross-section of the fountain-pen cap of FIG. 1 with the inserted tag; and FIG. 4 is an elevation of a further embodiment of the tag of the invention.

The data tag 1 shown in FIG. 2 has a basic rectangular shape and comprises on its left side a tab 2 and, on both sides of and facing the tab 2, resilient resting edges 3, 4. The edge lip 5 of the tab 2 running in the longitudinal direction of the data tag 1 is bent upward and out of the plane of the drawing toward the center of the tab around a folding line parallel to the side edge 6 of the data tag until the lip subtends an angle of 45° with the data tag 1. The size of the tab 2 in the longitudinal direction of the lip 5 corresponds to the length of the clearance between the clip 7 and the surface of the cap 8 of the fountain pen 9 shown in FIG. 1. One end of this clearance is bounded by the affixation end or yoke 10 of the clip 7 and the other end is bounded by the clip bead (not visible) at the free end of the clip 7.

To affix the data tag 1 to the cap 8, the data tag together with the tab 2 is inserted into the clearance underneath the clip 7, the lateral raised lip 5 facing the underside of the clip 7. At its underside, the clip 7 comprises a recess 11 in the form of a longitudinal groove entered by the end edge of the edge of raised lip 5 when the tab 2 has been inserted under the clip 7 until the resting edges 3, 4 abut the yoke 10 and the clip bead. After the edge of raised lip 5 has entered the recess 11, the tab 2 can no longer be removed from under the clip 7 in the direction opposite that of insertion short of destroying the lip 5. Instead and on account of its slanted position, the data tag 1 when being pulled tends to rise and as a result will be clamped between the clip 7 and the cap 8. In this manner, a relatively high retaining force is achieved. The data tag 1 is held in the longitudinal direction of the clip 7 by the tab 2 and the lip 5 because the data tag and the lip rest against the yoke 10 and the bead of the clip, the rest against the clip bead being further enhanced by the lip 5 being raised. Accordingly the data tag 1 is fixed in place in a predetermined direction and sufficiently firmly to the cap 8 of the fountain pen 9 while being tangentially spaced from the cap 8, as a result of which its top side and its underside can be read. As indicated in the drawing, the more visible top side may display features of the fountain pen and price. A machine-readable bar-code may be present on the underside of the data tag 1.

The data tag 1 is easily removable, for instance following purchase of the writing implement. Applying a somewhat larger force in the direction of insertion, the resting edge 3 may be slipped underneath and past the clip bead and the data tag 1 may be rotated until the end of the lip 5 near the clip bead no longer is underneath the clip 7. Thereupon the data tag 1 may be pulled out from under the clip 7 in the direction of the insertion aperture of the cap 8. The data tag 1 being undamaged by the removal, it may be used again if needed in the manner already described above and be affixed again to the cap or another cap.

FIG. 4 shows a second embodiment of the data tag 21 with a tab 22 comprising resting edges 23, 24 present on both sides of the tab. The tab 22 has a U-shaped incision 25 forming a raised lip 26. The lip 26 is folded about a connection line 27 connecting the open ends of the incision 25 and is bent out of the plane of the data tag 21 until it subtends approximately an angle of 45° with it. The raised lip 26 is arranged in such a manner that its raised front edge 28 is opposite the resting edges 23, 24. The data tag 21 is affixed to the clip 7 of the fountain pen 9 in the manner described above in relation to the data tag 1, the lip 26 snapping into the recess 11 underneath the clip 7.

I claim:

1. A data tag for a writing implement having a clip, the clip evincing a recess running in a clip longitudinal direction on an underside of the clip facing the implement, said data tag comprising a strip of material with a tab insertable into a clearance between the writing implement and the clip, said tab comprising at a top side facing the clip a raised lip formed by a folded edge of said tab, said lip being insertable by a raised end of said lip into said recess when the tab assumes an insertion position and said lip resting against the clip in a direction opposite a direction of insertion, said tab further comprising resting edges on each side of said raised lip which, for the purpose of limiting the depth of insertion of the tab abut an affixation end of the clip and a clip bead resting against the writing implement.

* * * * *